United States Patent [19]

Specht

[11] 4,416,033

[45] Nov. 22, 1983

[54] FULL BAG INDICATOR

[75] Inventor: Glenn E. Specht, Massillon, Ohio

[73] Assignee: The Hoover Company, North Canton, Ohio

[21] Appl. No.: 309,575

[22] Filed: Oct. 8, 1981

[51] Int. Cl.[3] ..... A47L 9/19

[52] U.S. Cl. ..... 15/339; 116/268; 55/274; 55/DIG. 34

[58] Field of Search ..... 15/339; 116/268; 55/274, DIG. 34

[56] References Cited

U.S. PATENT DOCUMENTS

| | | | |
|---|---|---|---|
| 3,119,369 | 1/1964 | Harland et al. | 55/DIG. 34 |
| 3,381,652 | 5/1968 | Schaefer et al. | 15/339 X |
| 3,678,882 | 7/1972 | Kinsella | 15/339 X |
| 4,070,170 | 1/1978 | Leinfelt | 116/268 X |

*Primary Examiner*—Chris K. Moore

*Attorney, Agent, or Firm*—Gerald H. Kreske; Richardson B. Farley

[57] ABSTRACT

There is provided a full bag indicator which is calibrated by movement of it along the structure it is mounted to, to thereby vary an aperture leading into the full bag indicator.

3 Claims, 7 Drawing Figures

FULL BAG INDICATOR

BACKGROUND OF THE INVENTION

1. Field of the Invention

The invention relates to floorcare appliances, and more particularly, relates to a full bag indicator to be used with such an appliance.

2. Description of the Prior Art

Full bag indicators have been long known in the floor care appliance art, such indicators taking a variety of configurations. A problem exists, however, relative to the calibration of these full bag indicators. This has been solved by the use of, for example, a threaded valve member which moves into and out of an aperture leading to the indicator so that the atmospheric pressure flow to which the full indicator is subjected may be varied to obtain an operative, relatively accurate structure mounted with floorcare appliance.

Although the use of such a means as known provides a satisfactory operation for the full bag indicator, a differing kind of calibration adjustment which more easily leads to an inexpensively manufactured full bag indicator would be advantageous.

Accordingly, an object to this invention to provide a calibration arrangement for a full bag indicator which is inexpensive.

It is a further object of this invention to provide calibration of a full bag indicator configuration which may be easily had on the manufacturing floor.

It is a still further object to provide a full bag indicator which may be mounted so as to slide along a floor care appliance as it is mounted to an aperture providing air flow to the full bag indicator to thereby permit calibration for accurate readout.

BRIEF SUMMARY OF THE INVENTION

A full bag indicator is preferably mounted in the lid of a cleaner on the underside thereof in a well which borders the rim of the full bag indicator both longitudinally and laterally. A clamp configuration attaches the full bag indicator in the well and is situated to permit longitudinal sliding of the full bag indicator as the same as calibrated.

The full bag indicator has a configuration of an open box having a top, sides and ends which are integral. A bottom is included which closes off the open side of the box like configuration to provide a closed compartment for the full bag indicator for a piston mounted within the compartment of the full bag indicator. The piston includes a spring attached to it which tends to urge the piston against the flow surge of atmospheric air which is imposed on it. The spring is attached to one end of the full bag indicator case for this purpose so as to be tensioned by the flow of atmospheric air. An integral pin forms the attachment of the spring to the box like configuration. At the spring end of the box like configuration is an aperture extending into and communicating with the confines of the full bag indicator box like configuration or case and imposing a pressure on the head of the piston. This aperture communicates with an aperture extending through the lid of the cleaner or the like, with an upstanding portion of the full bag indicator case extending through this aperture. The aperture is larger than the upstanding portion of the full bag indicator case so that movement of the full bag indicator case along the aperture relative to the clamp opens and closes the case aperture. Thus, calibration of the full bag indicator is had by varying atmospheric pressure flow to the full bag indicator by moving its case longitudinally along the aperture extending through the bag lid.

The opposite end of the full bag indicator case includes an aperture which communicates with the vacuum system of the floor care appliance so that the combination of this negative pressure and adjustment of the aperture leading to the indicator for the passage of atmospheric pressure flow past the piston gives a reading of full bag condition when the full bag indicator is properly calibrated relative to the aperture extending through the bag lid.

A gasket is disposed around a peripheral portion of the full bag indicator case to seal the full bag indicator case from leaks and additional atmospheric pressure flow to it other than afforded by the aperture provided.

The bottom piece of the full bag indicator case may be of green material while the piston may be red. At the same time, the indicator case, itself, can be transparent. Movement of the piston of the full bag indicator to indicate a full bag condition covers the green of the bottom piece as it moves below the viewing portion of the full bag indicator. This gives a visual readout of full bag conditions and alerts the user of the cleaner that it is time for changing the bag.

BRIEF DESCRIPTION OF THE DRAWINGS

Reference may now be had to the accompanying drawings illustrative of the invention, both as to its organization and function, with the illustration being of the preferred embodiment but being only exemplary.

DETAILED DESCRIPTION OF THE INVENTION

Figure 1:
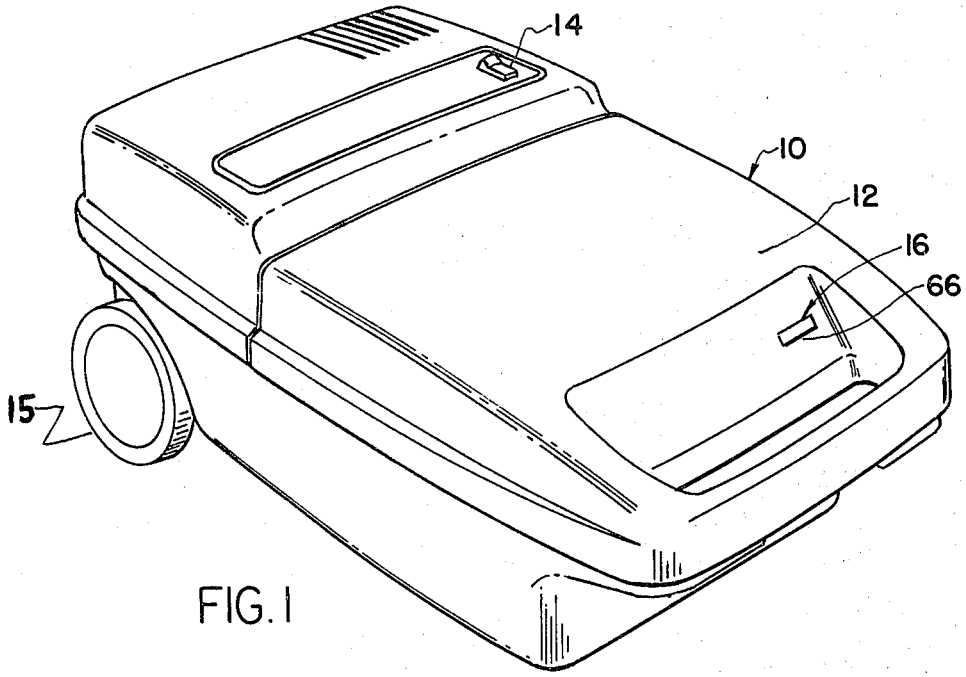
FIG. 1 is a perspective view of a cleaner including the full bag indicator of the instant invention.
Figure 5:
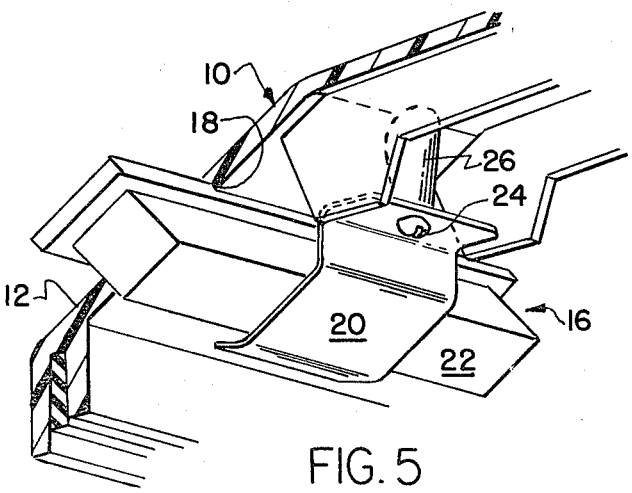
FIG. 5 is a partial perspective view of the underside of the bag lid showing the clamp which holds the full bag indicator in position.

Turning now to FIGS. 1 and 5, it can be seen that a cleaner 10 having a bag lid 12 which may be hinged (not shown) to the remainder of the cleaner 10 so as to be movable to an upward position to permit ingress to a bag cavity (not shown). The cleaner 10 includes an on and off switch 14 and wheels 15,15 (only one shown) which rollingly mount the cleaner 10 during the cleaner operation. A full bag indicator 16 mounted on the lid 12 with the cleaner 10 extends through the lid 12 of cleaner 10 so as to provide a readable means for indication of bag condition. The full bag indicator 16 is mounted in a depression or well 18 on the underside of bag lid 12 and is clamped in this position by a clamp 20 which extends around the bottom and sides of the full bag indicator 16 to engage against a bottom 22 of the full bag indicator 16 to hold the bag indicator 16 against the bag lid 12. The clamp 20 is held against the bottom 22 of the full bag indicator 16 by means of a screw 24 which mounts in a boss 26, integral with the bag lid 12.

Turning now to the remaining figures in the Drawing, it can be seen that the well 18 extends completely around the full bag indicator 16 providing a flat face 28 bordered by short vertical end walls 30,32 and side walls 34,36. It should be clear that, in view of the spacing of end walls 30 and 32, that the full bag indicator 16 has a certain amount of play therebetween and may be capable of being moved between the stops formed by these two end walls. A gasket 38 extends around the depression or well 18 by being captured within an integral rim 40 which extends around upper portion of the full bag indicator 16. The rim 40 is comprised generally of end walls 42 and 44 and side walls 46 and 48. The gasket 38 is trapped within this rim against the flat face 28 of depression or well 18 when the full bag indicators 16 is mounted by means of the clamp 20 to the bottom side of the full bag lid 12.

As set out previously, the full bag indicator is comprised of an open boxed configuration 50 and the bottom 22. The box like configuration 50 includes end walls 54 and 56 and side walls 58 and 60. A top 62 is also provided for this box like configuration 50, including an upwardly disposed portion 64 which serves as the viewing window for the full bag indicator 16, with this step portion 64 extending through an aperture 66 formed in the bag lid 12 of the cleaner 10. This step portion 64 is that portion of the full bag indicator 16 seen in FIG. 1.

The aperture 66 is somewhat larger than the upstanding step portion of 64 so as to provide an entrance port 68 for the entrance of a flow of atmospheric air to the internal portions of the full bag indicator 16. This entrance port 68 extends essentially across the width of the step portion, with the gasket 38 abutting the sides of the step portion 64 terminating the entrance port 68 and sealing off atmospheric air entrance to the internal portion of the full bag indicator 16 by any other means than the entrance port 68. It is noted that the gasket 38 seals generally the sides and terminating ends of the full bag indicator 16 away from the entrance port 68.

The end walls 42, 44 and side walls 46 and 48 of the rim 40 of the full bag indicator 16 essentially space the same from the bag lid 12 on its underside to provide a flow passageway from the entrance port 68 to the end of the full bag indicator 16 provided with another port 70. It permits entrance of atmospheric air flow through a chamber 72 of full bag indicator 16 causing an expansion or extension spring 74 to expand. This tends to move a piston 76 of the full bag indicator 16 against the imposition of spring force from spring 74.

The coil spring 74 is mounted within the piston 76 by means of a pair of integral clevis like or yoke pieces 80 and 82 which are mounted on the opposite sides of a spring end 78 of spring 74 and being spaced sufficiently apart as to permit the spring end to extend therebetween. Thus, tending to align the spring end and at the same time permitting attachment of it to them by means of a pin 84 which extends through bores 81 and 83 in yoke pieces 80 and 82, respectively.

The opposite end of the spring 74 is mounted with the box like configuration 50 by means of an integral pin 86 which extends downwardly medially of the width of the box like configuration 50 with a loop spring end 88 of a spring 74 permitting insertion of the spring over the pin 86 so as to provide its opposite tension point. It will be noted that the spring end 78 and 88 are mounted 90° relative to one another. This also tends to align and maintain the spring in proper operationing position.

Figure 2:
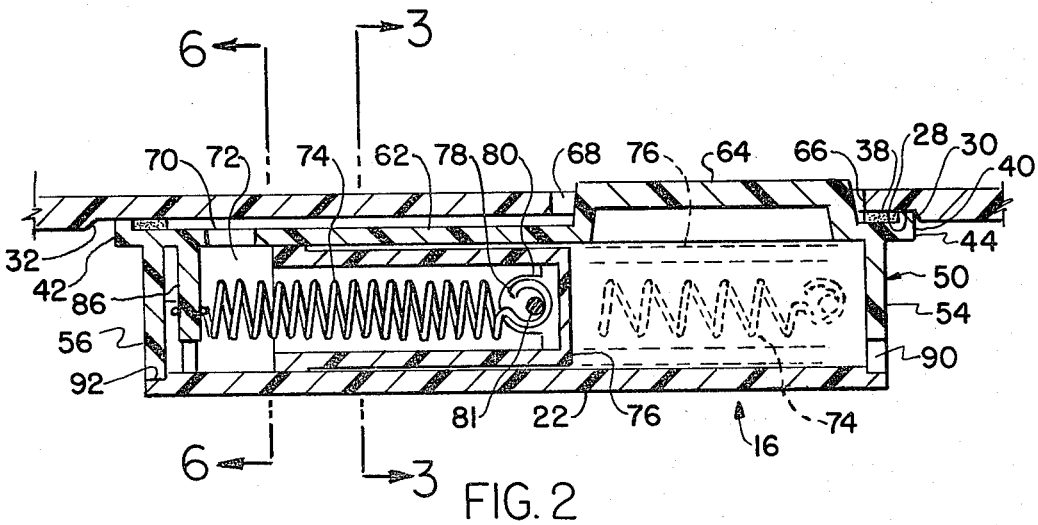
FIG. 2 is a central cross sectional view of the full bag indicator and bag lid.
Figure 3:
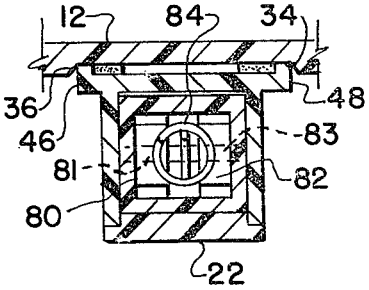
FIG. 3 is a cross sectional view of the invention taken along line 3—3 of FIG. 2.
Figure 6:
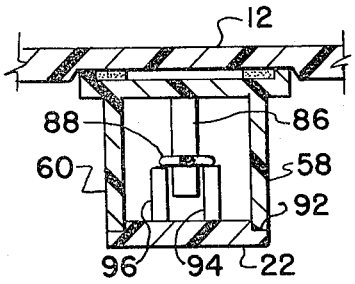
FIG. 6 is a cross sectional view of the full bag indicator taken on line 6—6 of FIG. 2.
Figure 7:
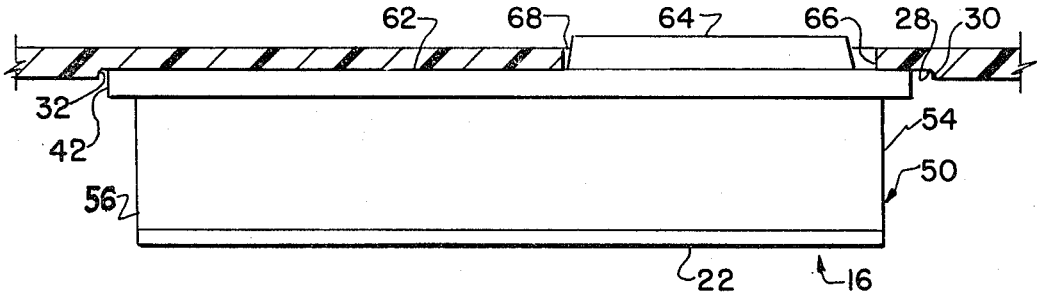
FIG. 7 is a view similar to FIG. 2 but showing the full bag indicator in another adjusted position.
Figure 4:
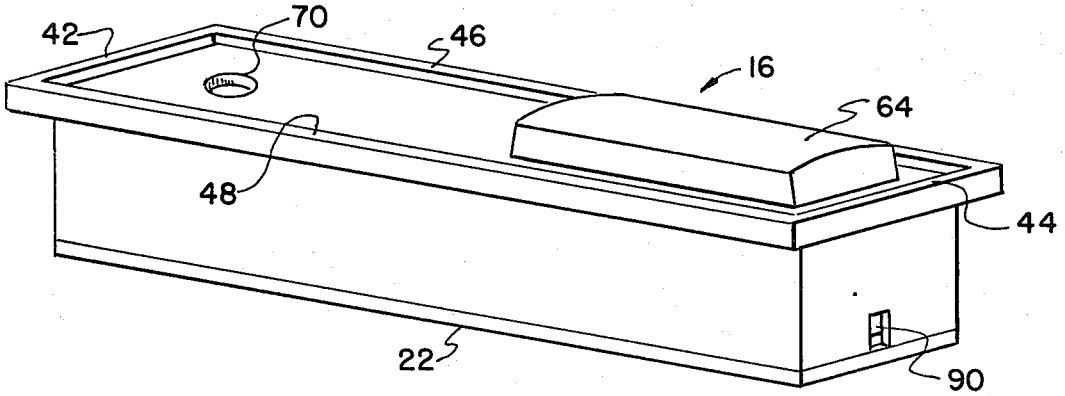
FIG. 4 is a perspective view of the full bag indicator in a demounted condition.

At the opposite end of the full bag indicator 16 at end wall 54 a rectangular hole 90 is provided adjacent its bottom and medially of the width of the box like configuration 50. This opens to the pressure in the bag cavity so that operation of the cleaner 10 tends to provide a force against the piston 76 to move it against the tension in the spring 74 to move the piston 76 towards the end wall 54. Such movement is shown in dashed lines in FIG. 2.

The bottom 22 of the full bag indicator 16 closes off the box like configuration 50 to seal the same and provide the afore mentioned chamber 72. It has a step configuration 92 so as to provide an easily assemblable connection with the box like configuration 50. The bottom 22 also includes upstanding pin 94,96 that extend upwardly in assembled condition on opposite sides of the pin 86 and abut the bottom side of spring end 78 to maintain the spring 74 in its assembled relationship with the open box like configuration 50. The bottom 22 is sonic welded to the open box like configuration 50 to provide an airtight condition between the two.

It should now be apparent how the full bag indicator 16 may be calibrated with maximum efficiency and without great difficulty. Entrance of atmospheric air through the port 68 works with the vacuum pressure provided through the port 90 tending to move the piston 76 under the step portion 64 of the top 62. In order to calibrate the full bag indicator 16 for a given vacuum indicating pressure, variances of atmospheric air flow through the port 68 is obtained by moving the full bag indicator leftwardly or rightwardly along the bag lid well, the clamp 20 only maintaining the full bag indicator in its fixed position during use of the cleaner and not preventing movement of the full bag indicator 16 when the same is urged by hand or by the use of a forcing tool in a linear direction against the full bag indicator along the bag lid 12. Such movement varies the dimensions of the port 68 relative to its width moving the top 64 closer to or further away from the abutting edge of the lid 12. this, then limits the amount of flow of atmospheric air to the chamber 72, reducing or increasing the atmospheric air pressure or the pressure differential on the piston 76, based on the flow past the piston 76 to vacuum pressure of the cleaner 10 versus the flow of atmospheric air from the port 68. Calibration of the full bag indicator 16 may thus be had easily and conveniently without the resort to things such as screw valves or the like.

Ideally the open box like configuration 50 may be made of transparent material to provide a viewing window through the step portion 64. At the same time the piston may be red to give an indication when the same is under the window of a full bag condition in the vacuum cleaner 10. During the period while the piston 76 is not beneath the window formed by the upstanding portion 64 a green bottom 22 provides a safe operating indication.

From the foregoing description it should appear clear that a full bag indicator arrangement has been provided which it easily calibrated by merely adjusting its mounting relative to the structure with which it is associated. It should also be clear that many modification would occur to one skilled in the art which would fall within the scope and purview of the description offered.

What is claimed is:

1. A bag condition indicator for a vacuum cleaner, including;

(a) a vacuum cleaner shell,
(b) an aperture in said shell,
(c) a housing for said bag condition indicator,
(d) a spring urged piston mounted in said housing such that air may flow between said housing and said piston,
(e) an aperture in said housing in an air flow path between said shell aperture and said piston,
(f) said housing being movably mounted on said shell to vary the flow area of one of said apertures to thereby alter the flow rate of atmospheric air passing through said housing aperture.

2. A bag condition indicator for a cleaner as set out in claim 1 wherein;
(a) said aperture in said shell receives a viewing window of said bag condition indicator.

3. A bag condition indicator for a cleaner as set out in claim 2 wherein;
(a) means for gasketingly sealing the bag condition indicator to the shell is provided,
(b) said means for gasketing generally limiting air flow into the bag condition indicator to flow through said aperture in said shell.

* * * * *